US005525031A

United States Patent [19]

Fox

[11] Patent Number: 5,525,031

[45] Date of Patent: Jun. 11, 1996

[54] AUTOMATED PRINT JOBS DISTRIBUTION SYSTEM FOR SHARED USER CENTRALIZED PRINTER

[75] Inventor: Elizabeth D. Fox, Bucks, United Kingdom

[73] Assignee: Xerox Corporation, Stamford, Conn.

[21] Appl. No.: 198,715

[22] Filed: Feb. 18, 1994

[51] Int. Cl.[6] ..... B65H 39/11

[52] U.S. Cl. ..... 414/789.7; 414/279; 355/322; 355/323

[58] Field of Search ..... 271/287; 414/279, 414/395, 789.7, 521; 355/321, 322, 323

[56] References Cited

U.S. PATENT DOCUMENTS

| | | | |
|---|---|---|---|
| 4,379,497 | 4/1983 | Hainsworth et al. | 180/168 |
| 4,549,804 | 10/1985 | Braun et al. | 355/14 SH |
| 4,564,185 | 1/1986 | Hamlin et al. | 270/53 |
| 4,707,297 | 11/1987 | Paske, Jr. et al. | 252/301.16 |
| 5,098,074 | 3/1992 | Mandel et al. | 270/53 |
| 5,127,486 | 7/1992 | Yardley et al. | 180/168 |
| 5,218,542 | 6/1993 | Endo et al. | 364/424.02 |
| 5,229,941 | 7/1993 | Hattori | 364/424.02 |
| 5,244,055 | 9/1993 | Shimizu | 180/168 |
| 5,276,618 | 1/1994 | Everett, Jr. | 364/424.02 |
| 5,280,431 | 1/1994 | Summerville et al. | 364/424.02 |
| 5,281,901 | 1/1994 | Yardley et al. | 318/587 |
| 5,342,034 | 8/1994 | Mandel et al. | 270/53 |

*Primary Examiner* Karen B. Merritt
*Assistant Examiner* Janice L. Krizek

[57] ABSTRACT

An output sheets collection, separation and distribution system for printed sheets outputted from a shared centralized printer to which plural remote users electronically send respective print jobs from a plurality of separate user sites remote from said centralized printer location. A mobile vehicular mailboxing module is docked with the printer to collect the print jobs stacked in plural user-assigned mailbox bins by an internal sheet feeding and distribution system. The mobile mailbox module is then undocked and automatically sequentially driven to the separate remote user sites and distributes the respective print jobs to the respective users at those sites, or other designated sites, stopping only at those sites for which the moving mailboxing module contains designated print jobs in one or more bins. The remote user sites may have separate stationary print job delivery bins and the plural users may have distinguishable electronic codes, and the mailbox bins may have lockable access restricting privacy doors respectively electronically unlockable by user access codes, which may be automatically provided at the job receiving sites by digital signal sources there.

10 Claims, 4 Drawing Sheets

CONTROLLER
100
10
DISPLAY
111
52
11
10
20
20
12
17
22
13
13
23
130
130
102
102
103
106
106
104

AUTOMATED PRINT JOBS DISTRIBUTION SYSTEM FOR SHARED USER CENTRALIZED PRINTER

Cross-reference and incorporation by reference is made to commonly assigned co-pending 1993 applications by Barry P. Mandel, et al on the subject of electronic printer output print jobs "mailboxing", and art cited therein, including: U.S. Pat. Nos. 5,342,034; 5,358;238; 5,308,058; and 5,328,169.

Centralized or shared users electronic printers typically have not provided sufficient automatic separation, much less distribution, of the various copies of various document sets which are presented to the printer for hard copy (printed sheets) reproduction (directly or by being sent electronically over an electronic network). There have been recent developments in "mailboxing" systems for separating print jobs from different printer users into separate "mailboxes" or bins, connecting with a printer output, as more fully explained in the above and below cited art. However, such multibin mailbox units are stationarily connected to the printer at the printer location, and thus still requires every user or secretary to go to the central printer site to retrieve each and every job printed by that printer for that user from the respective mailbox(es) assigned (permanently or temporarily) to that user. That may be a long walk in each case from the users workstation to the printer site in a large office building or factory. Furthermore, if the printer mailboxes or bins are not periodically cleared often enough of their print jobs, there will not be enough remaining bin space for further jobs and/or further users. The business world is rapidly adopting more electronically networked shared use of centralized high productivity electronic printers, including color printers, especially high cost high speed printers with various optional automatic on-line finishing features such as on-line booklet binding. All aspects of such print jobs can now be generated, controlled and directed from the user's own local terminals or P.C.'s, except for retrieval of the resultant hard copy output. That is, all job selection controls and/or "desktop publishing" features can be directed by local terminal selections on electronic "job sheets" or page description language (PDL) systems or the like, or encoded facsimile cover sheets, sent over networks of wire, cable, fiber optics, radio, infrared or other transmission media, from any of the remote user's terminal or workstations. Furthermore, users on one network may also wish to distribute hardcopy from centralized printers at other locations on other networks to which they have access, for distribution to readers from those other printers at those other locations, even in different countries. This has been called "distributed printing". Examples of well known shared user high speed electronic printing and finishing systems include Xerox Corporation "DouTech"™ and "4890"™ printing systems. Besides normal print jobs, these and other laser or other electronic printers can be remotely accessed or routed by user terminal screen selection, or automatically, for printouts of facsimile messages, or forwarded hardcopies of electronic mail.

The alternative of having separate dedicated printers at each desktop or user site is expensive. Small printers have much higher per-page printing costs, are much slower and less reliable, and require more maintenance and local space. Furthermore, small local printers do not normally or readily provide many sophisticated or professional quality printing and finishing options, such as tape binding or signature sets printing and center bookbinding, tabs, cover or photo inserts, etc.

Thus, there is an increased need for more efficiently getting sets of hardcopies from a centralized printer back to the users at their own sites or "mailstops", rather than making everyone walk to a printer site and unscramble their jobs from a common stacker pile, or manually uncode and open locked mailbox bins to retrieve their jobs from bins. Furthermore, smaller separate user bins require frequent manual unloading to be reusable, whether lockable or not.

Examples of some recent patents relating to network environments of plural remote terminal shared users networked printers include Xerox Corporation U.S. Pat. Nos. 5,113,494; 5,181,162; 5,243,518; 5,226,112; and 5,170,340; and 5,113,355 and 5,220,674 by others. Further by way of background, some of the following Xerox Corporation U.S. Pat. Nos. also include examples of systems with a network, server or spooler, and printer: 5,153,577; 5,113,517; 5,072,412; 5,065,347; 5,008,853; 4,947,345; 4,939,507; 4,937,036; 4,920,481; 4,914,586; 4,899,136; 4,063,220; 4,099,024; 3,958,088; 3,920,895 and 3,597,071. Also noted are IBM Corp. U.S. Pat. Nos. 4,651,278 and 4,623,244.

Some networking publications include "Interpress™": The Source Book", Simon & Schuster, Inc., New York, New York, 1988, by Harrington, S. J. and Buckley, R. R.; Adobe Systems Incorporated "PostScript® Language Reference Manual", Addison-Wesley Co., 1990; "Mastering Novell® Netware®", 1990, SYBEX, Inc., Alameda, CA, by Cheryl E. Currid and Craig A. Gillett; "Xerox Network Systems Architecture", "General Information Manual", XNSG 068504 April 1985, with an extensive annotated bibliography, ©1985 by Xerox Corporation; "Palladium Print System" ©MIT 1984, see; "Athena85" "Computing in Higher Education: The Athena Experience", E. Balkovich, et al, Communications of the ACM, 28(11) pp. 1214–1224, November, 1985; "Apollo87" "The Network Computing Architecture and System: An Environment for Developing Distributed Applications", T. H Dineen, et al, Usenix Conference Proceedings, June 1987. Noted are commercial network systems with printers is the 1992 Xerox Corporation "Network Publisher" version of the "DocuTech®" publishing system, including the "Network Server" to customer's Novell® 3.11 networks, supporting various different network protocols, and "Ethernet™". Also, the Xerox Corporation "9700 Electronic printing System"; the "VP Local Laser Printing" software application package, which, together with the Xerox "4045" or other Laser Copier/Printer, the "6085" "Professional Computer System" using Xerox Corporation "ViewPoint" or "GlobalView®" software and a "local printer Option" kit, comprises the "Documenter" system. The even earlier Xerox Corporation "8000" "Xerox Network Services Product Descriptions" further describe other earlier Xerox Corporation electronic document printing systems. Eastman Kodak "LionHeart™" systems are also noted. Current popular commercial "systems software", which includes LAN workstation connections, includes Noval® DOS 7.0, "Windows™" NT 3.1, and IBM OS/2 Version 2.1.

The present system overcomes these and other problems, yet can even be implemented in large part with components of existing known technology. The embodiment disclosed herein combines a mailboxing system such as that of the above cross-referenced applications married to an existing automatic self-directed and self-stopping mailcart system. As further disclosed herein, the present system can be further automated, if desired, to automatically stop this roving print job mailboxed delivery system at an assigned stationary job delivery bin at each particular printer user's site, unlock, and discharge that particular user job from that particular assigned mailbox bin into that assigned stationary bin at that particular user's site, which may also be a locked bin at that site.

Locked mailboxes can be used for improved document security and protection from loss, by preventing non-authorized personnel from rummaging through, scattering, reading or removing print jobs of others in other mailbox bins. The above-cited patents, for example, and art cited therein, describe examples of how to automatically open a selected locked mailbox bin. Also noted is Xerox Corp. EPO published App. No. 0 241 273; allowed U.S. Pat. Nos. 5,295,181 and 5,308,058; and U.S. Pat. No. 4,348,101; and Gradco Canadian Application No. 2,090,886A1, Published Sep. 11, 1993, based on U.S. Ser. No. 849,223 filed Mar. 10, 1992, and other art cited therein. (Another Xerox Corp. patent relating to restricted code access to a type of locked output bin or purging bin is U.S. Pat. No. 5,270,773, issued Dec. 14, 1993, filed Nov. 27, 1992.) Thus, this need not be described in detail herein.

Another optional feature here, also disclosed in said above cross-referenced cases, and art cited therein, is 90 degree sheet rotation, in the mailbox module, or an interface connection module or transport, or otherwise. Also, set collection systems in which sheets enter and are stacked from one direction and then pushed out or ejected from an orthogonal or 90 degree different direction. Other sheet feeding mechanisms for a 90 degree change in sheet path direction are well known, e.g, Canon U.S. Pat. No. 5,205,551, Xerox Corporation U.S. Pat. Nos. 4,733,857 and 5,090,638, and art cited therein.

Withdrawal or ejection of copy sets from respective bins of a sorter, collator or bindexer system, e.g, with a gripper extractor, but for on-line stapling and stacking, as in the Xerox Corporation "9900" duplicator, is shown for example in Xerox Corporation U.S. Pat. No. 4,489,804 to Braun et al.; U.S. Pat. Nos. 4,361,393 or 4,411,515 to Noto or a U.S. Pat. No. 4,385,827 variant, and U.S. Pat. No. 5,024,430 issued Jun. 18, 1991 to Nobuyoshi Seki et al. (Ricoh). Set finishing and removal from moving bins is shown in U.S. Pat. No. 4,564,185. These or other bin content removal systems may be used. E.g., tamper/pushers, or simple gravity unloading from sloping bins when a bin door is opened, may be utilized for automatic mailbox bin unloading.

There are important differences between a job "mailboxing" system or module and a traditional sheet output sorter (also called a collator), although at least partially similar hardware and sheet transports may be employed. This is explained in the above cross-referenced and other literature. In particular, "Mailbox(ing) may comprise temporarily (or semi-permanently) assigning a unique predetermined electronic address to designated ones of plural bins of a sorter-like output device and enabling a user's output to be directed into a selected bin so assigned. It may or may not include locked bins. Preferably, the user's mailbox output is plural, pre-collated, jobs with all sheets going to a single bin, not requiring sorting. "Sorting" conventionally refers to sending one copy sheet of each original page into one bin of a sorter, the next copy sheet into the next bin, etc., repeated for the number of copies, until each of the plural bins required has one copy, then stacking one copy sheet of the next original in each said bin, etc, to compile one collated set in each bin. Thus, job or addressee "mailboxing" is not "sorting" in the common or usual sense of collating plural identical copy sheets by sequentially placing each sheet in a different bin, and repeating those steps. However, similar "sorter" hardware may be employed in part if it can provide rapid random bin access and other desired features. To express it in another way, a "mailbox" in the example herein takes multiple print jobs from a printer (from user terminals, fax, networked page images, scanned document jobs, or the like, or combinations thereof) and separates these jobs by users and stacks these hardcopy outputted print jobs into individual bins for individual users, by users. (As an additional software option, users may also send print jobs to other users' mailbox bins if desired.) Mailbox bins can, in general, be either user assignable, or automatically assigned by the printer, print server, or mailbox unit. Optionally, jobs can be individually stapled if a stapler unit is provided. Optional security doors can be added to any or all bins if desired. An overflow bin or general, shared, stacking tray may also desirably be provided, not assigned to any one user.

Some examples of issued patents relating to "mailboxing" include Xerox Corporation U.S. Pat. No. 5,098,074 issued Mar. 24, 1992 to Barry P. Mandel, et al (D/88157), especially FIG. 4 and its description and the last paragraph of the specification. Of particular interest, an example of means for printer job set ejection into a selected mailbox is shown in this Mandel et al Xerox U.S. Pat. No. 5,098,074. Also shown here is that one desirable feature of "mailbox" bins or stacking trays is to store plural (more than one) bound (e.g. stapled) sets in a selected assigned one or more mailbox bins or stacking tray (i.e. so that any particular user-designated bin can store plural stapled sets from the same or different jobs). Of more general background, U.S. Pat. No. 4,691,914 issued Sep. 8, 1987 to F. J. Lawrence (Gradco Systems, Inc.) discloses a random plural bin access (with plural solenoids) sheet receiver with sheet input from both the right or left sides, indicated as from a copier and a printer respectively. Gradco Systems, Inc. U.S. Pat. No. 4,843,434 filed Nov. 17, 1987 and issued Jun. 27, 1989 to F. Lawrence et al. has a brief discussion of "mailboxing" for electronic or laser printers in Col. 1, lines 28 et al., noting in particular there that: "mailboxing is more difficult, because the documents or jobs destined for different mailboxes may not and most likely will not be processed in sequence. Thus, mailboxing requires random access or positioning of the sheet feed for delivery to a selected bin or mailbox." (Col. 1 lines 37–42). This specification then goes on to indicate that rapid bin movement is a problem for that in the prior art sorters, and that high speed job separation and ease of random access operation is desired. Of further "mailbox" interest is Seiko Epson Corporation U.S. Pat. No. 5,141,222 issued Aug. 25, 1992 by Shigeru Sawada, et al., (and its equivalent EPO Application No. 0 399 565, "Printer", published Nov. 28, 1990). Note that either a mailbox or a sorter may also include finishing, such as stapling, to output jobs as bound sets. Also, common (shared) job overflow or high capacity stacking trays, fed from the same or additional alternative sheet paths, may be provided.

Automatic electrical self propelled robotic mailcarts or "mailmobiles" are in well known commercial use for delivering mail around preset guidepath routes inside large commercial buildings, with automatic or initiated stops at preset sites for pickup of mail from previously loaded plural mailbins thereon. One well known example is the "Sprint"™ mail delivery vehicle sold by Bell & Howell Company, Zeeland Mich. 49464-1395.

However, these are for manually loaded and unloaded mail, and have not been suggested for, or integrated with, networked electronic printing systems with shared users sending printing jobs to a centralized electronic printer. By way of background, some examples of patents on automatically guided vehicles (AGV) include Bell & Howell 4,707,297 and 4,379,497; and recent patents by others such as 5,281,901, 5,280,431, 5,276,618, 5,244,055, 5,229,941, 5,218,542, and 5,127,486 (including arrival sensing).

A specific feature of the specific embodiment(s) disclosed herein is to provide an output sheets collection, separation and distribution system for printed sheets outputted from a shared centralized printer to which plural remote users electronically send respective print jobs, said plural remote users being located at a plurality of separate user sites remote from said centralized printer location; comprising a mobile mailboxing module dockable with said centralized printer to collect said outputted sheets, said mobile mailboxing module having an arrayed multiplicity of user-assigned mailbox bins and a distribution system for automatically collecting said output sheets of said centralized printer in user print jobs of plural said output sheets which are stacked into different user-assigned mailbox bins for different respective users of said centralized printer, said mobile mailboxing module distribution system including a sheet feeding system for automatically feeding said outputted sheets from said centralized printer to said respective user-assigned mailbox bins to stack said user print jobs therein, and said mobile mailbox module being automatically sequentially movable as a vehicular print jobs distributor to various said plurality of separate user sites remote from said centralized printer for distribution of said print jobs to respective said separate user sites from which print jobs were electronically sent to said centralized printer to be printed and stacked into said user assigned mailbox bins of said mobile mailboxing module.

Further specific features provided by the system disclosed herein, individually or in combination, include those wherein said printer and said mobile mailboxing module therefor are shared by said remote plural users having respective distinguishable user electronic codes; and/or wherein at least some of said mailbox bins have lockable access restricting privacy doors respectively electronically unlockable by said respective remote user electronic access codes; and/or wherein at least some of said separate remote user sites have separate stationary print job delivery bins located at said sites; and/or wherein said mobile mailboxing module further includes an automatic unloading system for unloading said print jobs from respective user-assigned mailbox bins into respective said stationary print job delivery bins for said users at said user sites; and/or wherein said separate user sites have separate stationary print job delivery bins, and said mobile mailboxing module further includes an automatic unloading system for unloading said print jobs from respective user-assigned mailbox bins into said stationary print job delivery bin for said user at said users site in response to said user electronic code; and/or further including an additional, stationary, mailboxing module maintained at said printer and connected to said printer to selectively alternatively collect said output sheets of said printer in an arrayed multiplicity of mailbox bins in user print job sets of plural said output sheets per job set stacked into different respective user-assigned mailbox bins; and/or wherein said mobile mailboxing module automatically stops at said stationary print job delivery bin at a said printer user's site and unlocks at least one said mailbox bin and discharges that particular user's print job from that particular user's assigned mailbox bin into that stationary bin at that particular user's site; and/or wherein said stationary print job delivery bins comprise a plurality of separate and normally locked mail bins for designated users, which locked mail bins at that site are automatically unlocked by said mobile mailbox module when said mobile mailbox module contains a print job for that designated user; and/or wherein said remote users may also optionally direct print jobs to be delivered to other sites; and/or wherein plural said mailbox bins are lockable and are electronically unlockable by remote site print job receivers when said print job receivers are approached by said vehicular print jobs distributor.

As to usable specific or alternative hardware components of the subject apparatus, it will be appreciated that, as is normally the case, some such specific hardware components are known per se in other apparatus or applications. For example, various commercially available stand-alone, self-controlled modular sorter units are known for sorting the output of xerographic copiers or printers, with various hardware systems. Examples include above-cited art and its references. All references and products cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below, as well as the claims. Thus, the present invention will be better understood from this description of an embodiment thereof, including the drawing figures (approximately to scale) wherein:

Figure 1:
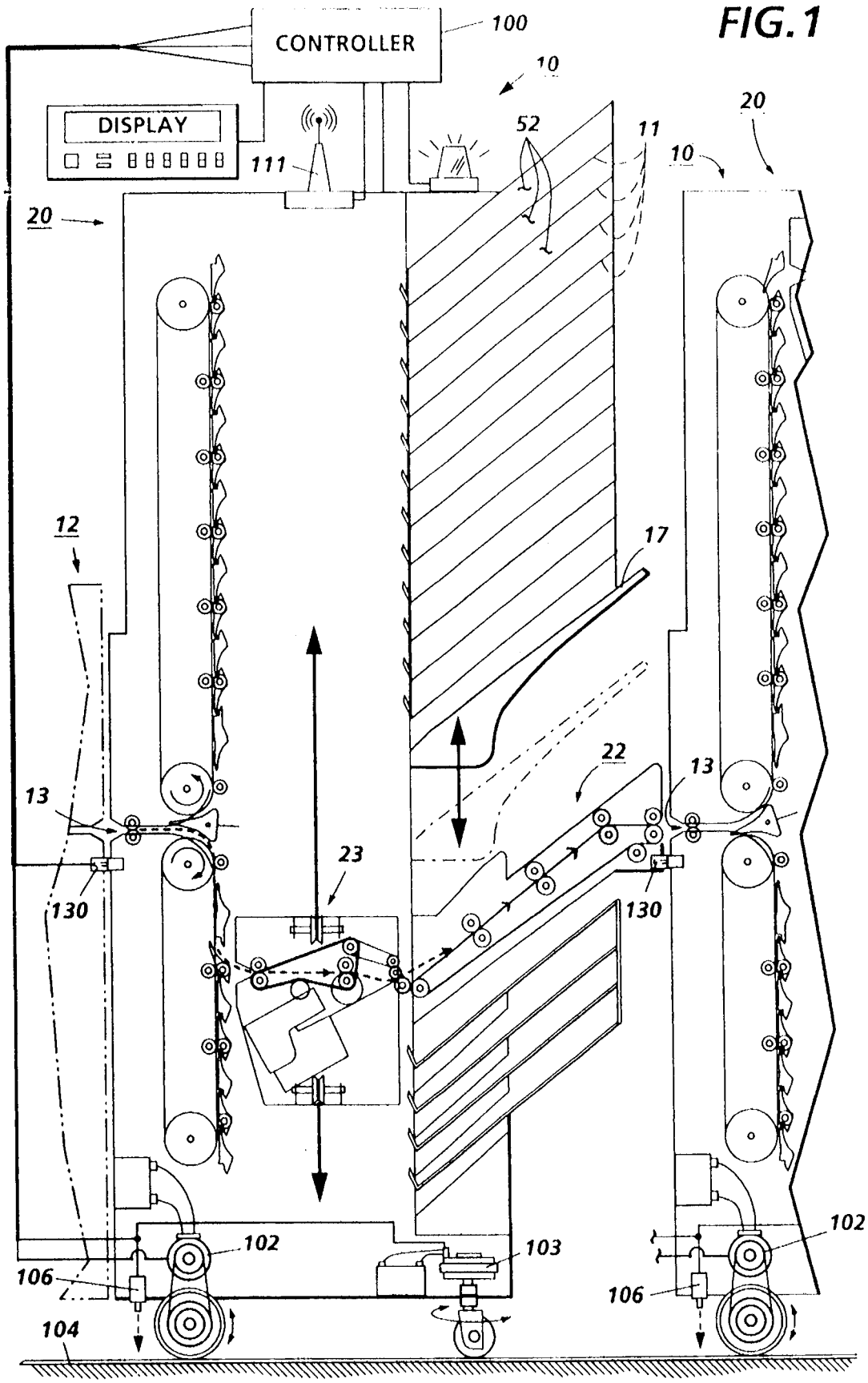
FIG. 1 is a schematic view of one embodiment of a centralized printer job mailboxing and job distribution vehicular module in accordance with the present invention.

Turning now to this illustrated exemplary embodiment 10 of a centralized printer job mailboxing and job distribution system, an automatically movable mailbox unit 20 is shown, with multiple mailbox bins 11. It will be appreciated that this multibin output unit 20 is merely one example of one application of the system 10. The printer 12 to which this mailbox system 20 may be operatively connected is only partially shown, for its output in FIG. 1, left side, since any of various printers may be so connected to the input 13 of this moving mailbox unit 20, with little or no printer modifications. Another printer 12 example is shown in the upper right in FIG. 4.

An optional stationary or non-movable mailbox system may be provided, which may be similar to (or different from) the unit 20. As shown here, if such a stationary mailbox is also provided, it may be ganged to the same printer output by providing a bypass path 22 through the stationary mailbox module from the printer output to the input 13 of the detachable and movable mailbox unit 20.

The illustrated mailbox bins, compiler/stapler, etc. illustrated or described herein are also exemplary, and may individually vary considerably. Various detailed examples are disclosed in the above cross-referenced and cited art. Thus, they need not be described in detail herein.

Referring to FIG. 1, the entire operation of the exemplary mailbox module unit 20 here may be controlled by an integral conventional programmable microprocessor controller 100, conventionally programmed with software for the operations described herein. Such a system has more than ample capability and flexibility for the functions described herein, and also for various other functions if desired, such as jam detection and jam clearance instructions.

As shown in FIG. 1, the controlled movement of the module 20 may be by a drive motor 102 driving some of the unit 20 wheels. The unit 20 wheels, which are also pivotable at least one end by a steering motor 103, may be controlled by an optical sensor 106 tracking a U.V. reflective strip or other guide path 104, as in the above-described and identified commercial mail delivery vehicles. Magnetic or other alternative tracking or guiding and stopping systems may be used.

Figure 2:
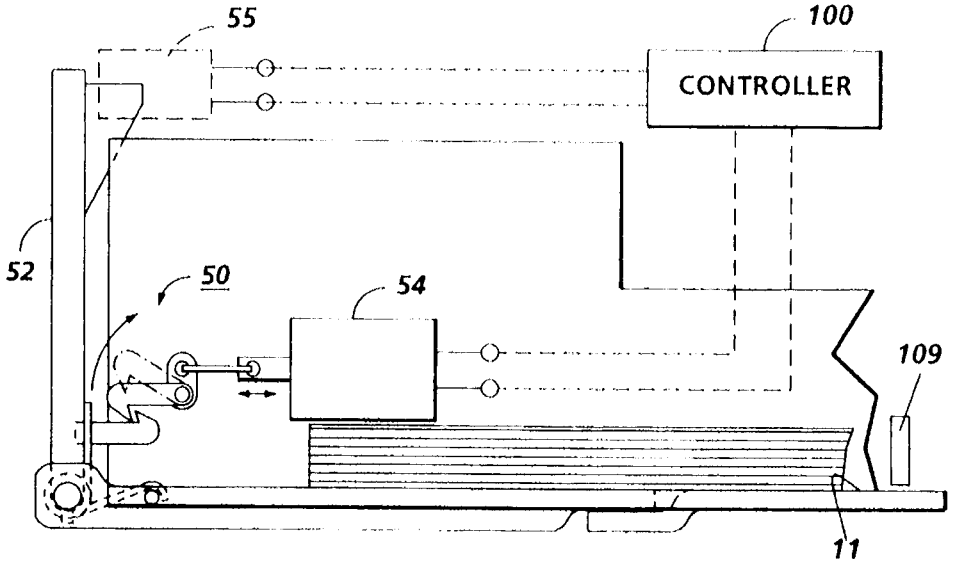
FIGS. 2–3 show an example of an automatic mailbox bin door unlocking, opening and set ejection system therefor.
Figure 3:
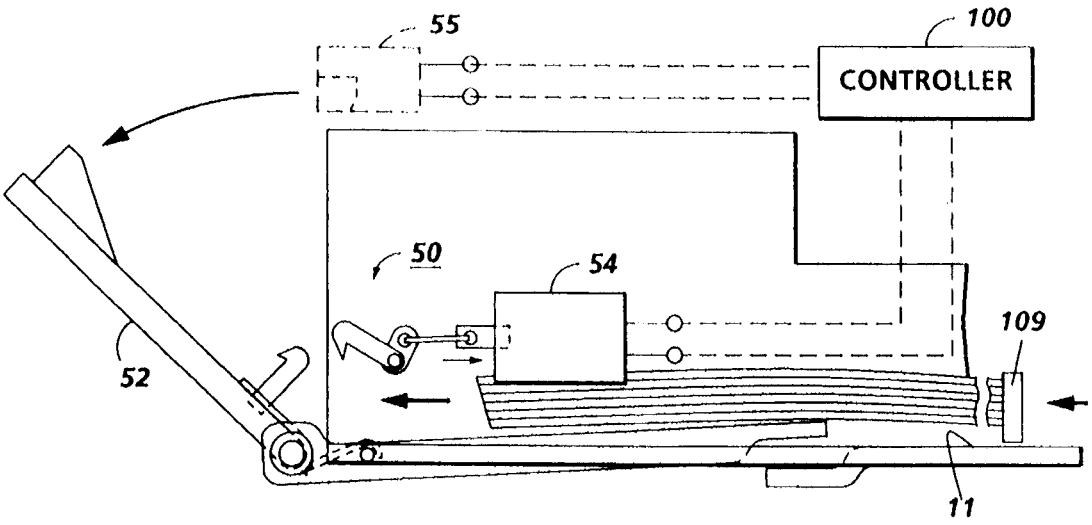

As shown in FIGS. 2–3, some or all of the bins providing the described function here may be equipped with locked but automatic unlocking system 50 latch (solenoid 54, door open sensor 55) bin privacy doors 52 as described in the references cited above. Automatic job sets (bin contents) ejectors 109 may also be provided in each bin 11 to push out the print job sets therein automatically after the door of that bin has been automatically opened by that or some other system.

When the particular user or job delivery site, such as 110*a*, 110*b*, 110*c*, etc., is reached by the moving mailbox module 20, the module 20 may be automatically stopped and docked at a stationary print job delivery bins unit 120 at that user site by various systems of the cited art, and/or digital signals as described below. The delivery bins units 120 may have plural mail bins 121 with normally locked covers or doors 122 which then automatically open to receive the print jobs ejected from the mailbox unit 20 bins 11 by their ejectors 109 through their unlocked bin privacy doors 52. These print job delivery mail bin 121 doors 122 may be opened by a low power digital signal from a transmitter/receiver 111 on the delivery module 20 received by a like receiver 112 on unit 120 when module 20 approaches, and/or when docking sensor 130 is engaged at that site. The docking sensor 130 may also be provided with unique digital code signals. More than one delivery bin unit 120 may be provided at a job delivery site.

Figure 4:
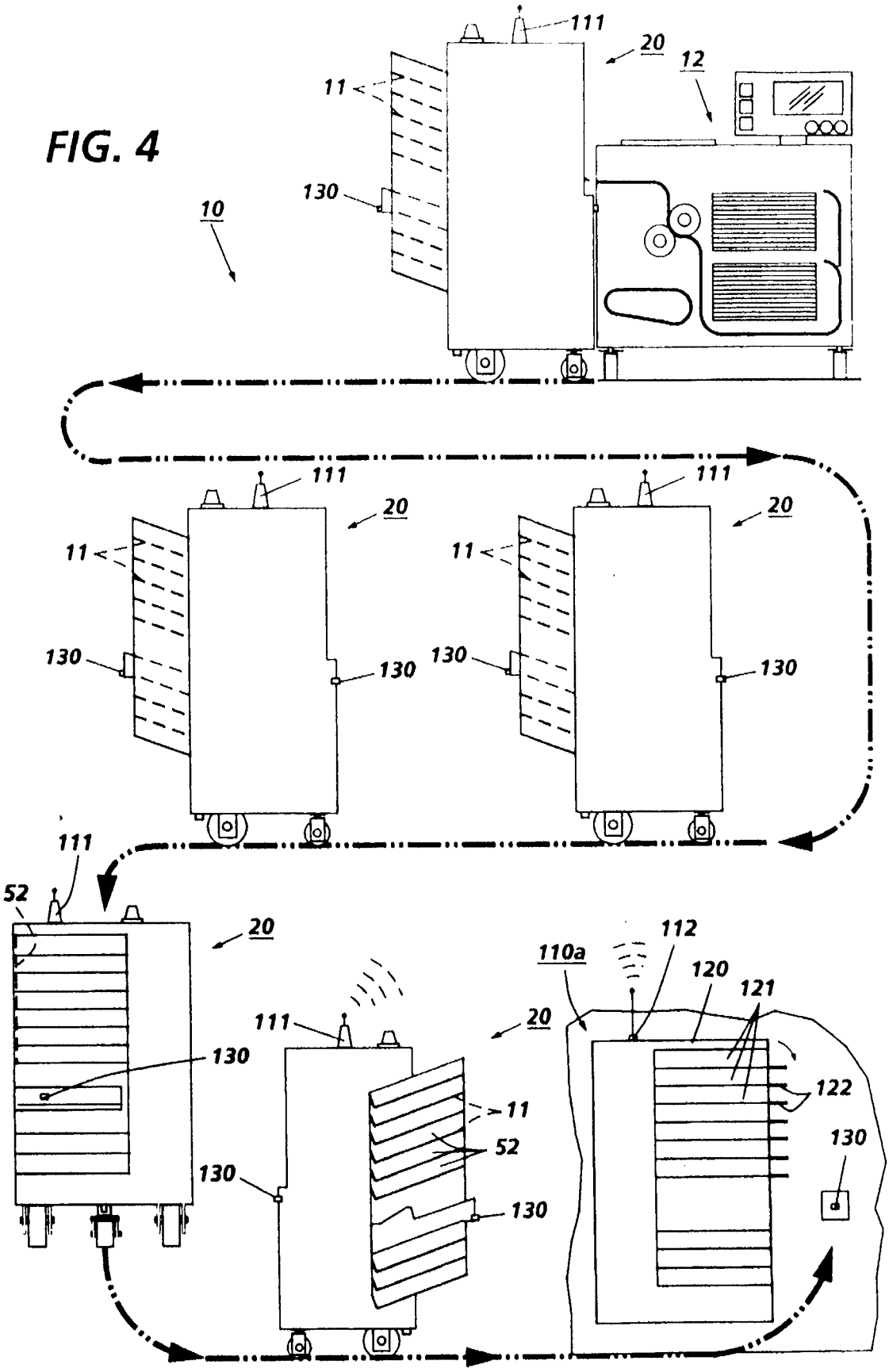
FIGS. 4–5 are schematic frontal views of an exemplary overall print job distribution system showing the movement of movable modules such as those of FIG. 1 to separate user sites having print job receiving stations.
Figure 5:
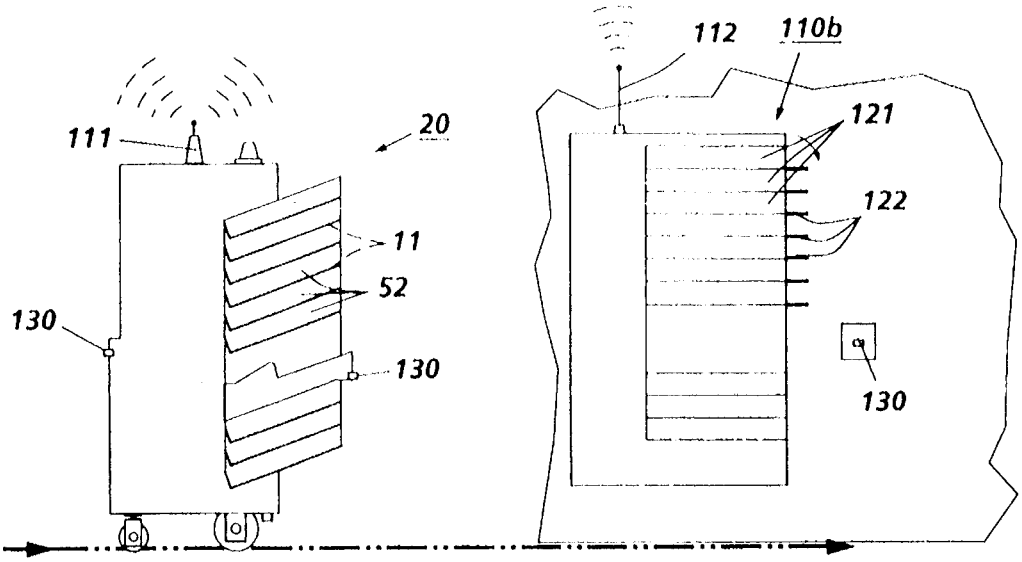

The controller 100 knows which user has at least one print job in at least one mailbox bin 11. If not, the unit 20 need not stop at that site in its distribution circuit from and back to the printer 12. The unit 20 routes may be around fixed or predetermined circuit routes, or different routes calculated in each case to go only to users with jobs therein by the most efficient route, and/or go to a highest priority customer first. Users may also direct deliveries of their jobs to other sites, optionally. Optionally, as shown in FIG. 4, more than one unit 20 may be moving in route to user sites at once, separately, or in trains of units serially docked. A route locater may be provided on the printer 12 or at another central base location to tell where a roving mailbox 20 is presently located, to recover a job, or to redirect the unit 20.

This particular exemplary embodiment mobile printer output "mailbox" job sorting module 20 has an integrated job compiler/finisher unit, such as compiler/stapler 23, although this system is not limited thereto. In fact, the roving mailbox unit 20 can also be used to deliver print jobs to off-line finishing, binding, wrapping, and/or shipping or mailing boxes or sites.

As described in said cross-referenced applications, this exemplary disclosed mailboxing system provides for stacking the sheets sequentially outputted from a printer in separate job sets into one or more temporarily and variably assigned "mailboxes" (bins) 11 of a mailboxing or job sorting unit 20 having a number of such variably assignable mailbox bins 11. For mailboxing functions, the conventionally sequentially received hard copy of plural page collated documents from a pre-collation output electronic printer or the like may be fed into the mailbox unit 20 and automatically fed to the particular bin 11 assignment destination of those job sheets. The mailbox unit controller 100 preferably directs all designated sheets of a users job to an available bin or bins 11 temporarily assigned to that printer user based on bin availability. A variable display may indicate the bin(s) into which that particular user's jobs have been placed last and not yet removed. These may be plural pre-compiled and/or prestapled job sets stacked in a user bin, as by unit 23. The exemplary disclosed system may also provide a bypass for sequentially stacking unstapled user sheets directly in a selected mailbox 11 without compiling and stapling. An integral moving sheet deflector, compiler and stapler unit 23 is shown here for collecting, compiling, and optionally stapling, and ejecting job sets of sheets for separate designated users into one or more of these discrete but variably assigned "mailboxes" 11. As noted, some or all of the disclosed mailbox bins 11 may desirably have "privacy doors" such as 52 for restricting access to those mailbox bins, with electrical door unlocking of selected bins in response to entry of an access code, and other user features.

The user access code may be automatically generated by the controller 100 as its path markers indicate reaching the particular user site. However, preferably, the unique access mailbox bin door(s) opening code may be provided by unique low power digital signal radio transmissions from or adjacent the particular delivery bin unit 120 (like well-known garage door opener systems) such as 112, received by transmitter/receiver 111 on module 20. Another alternative signaling system and/or near-presence indicator for the vehicular print jobs distributing module 20 and the site print job receivers 120 is digital pulse encoded IR signal transmitters and receivers, which are well known for low cost remote control of home television or sound equipment, etc., e.g., U.S. Pat. No. 4,897,883 to C. Harrington, and art cited therein.

Figure 6:
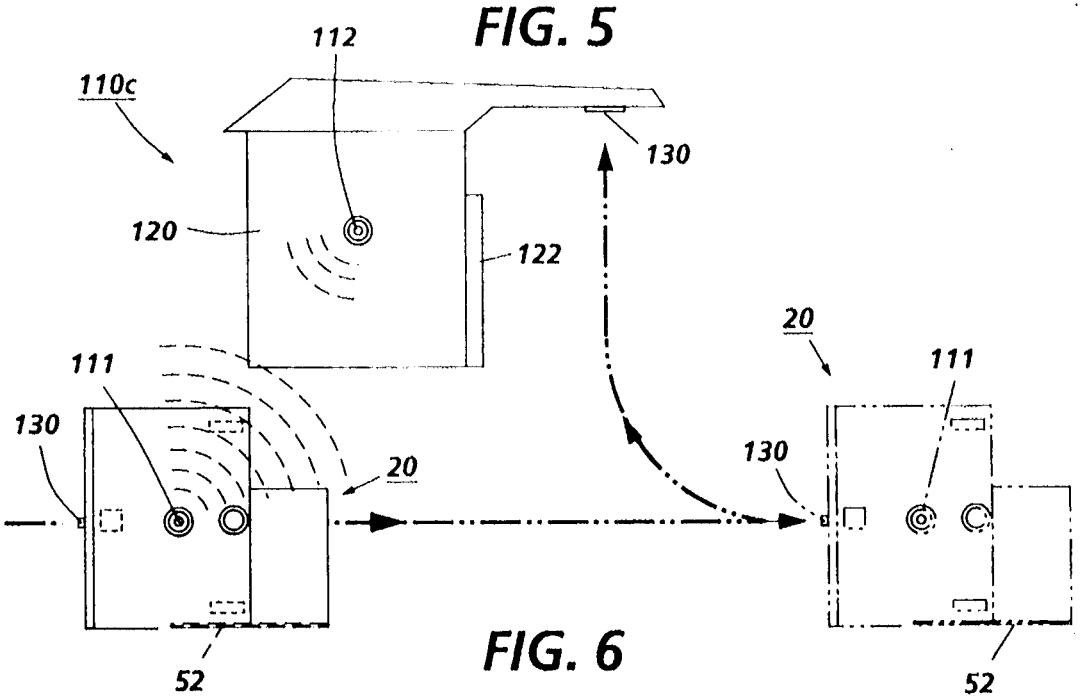
FIG. 6 is a top view of an exemplary automatic docking operation of a vehicular module of FIGS. 1–5 with another of the print job receiving stations of FIGS. 4–5.
Figure 7:
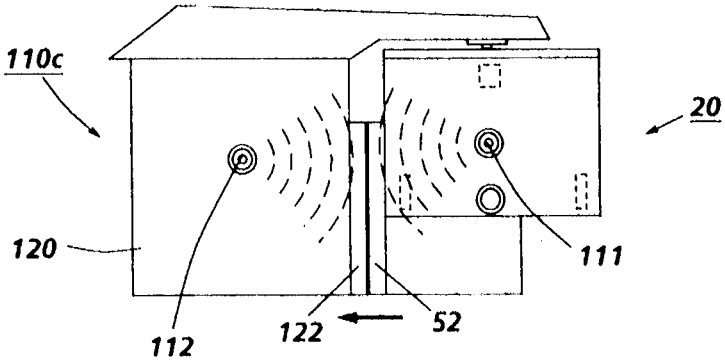
FIG. 7 shows a fully docked job set interchange, as a continuation of FIG. 6.

Whenever the mailbox unit 20 is sufficiently full of print jobs for various remote users, or upon other desired commands (pre-set times of day deliveries and/or user requests, or the like) the mailbox unit 20 automatically unlocks from the printer and the battery powered motor 102 moves unit 20 around its system route to automatically stop and unload user print jobs at sites 110 of those remote users who have sent print jobs to that printer or other sites selected by users for delivery of their print jobs. A flashing warning light may also be provided on top of unit 20, as shown, while moving and/or unloading. At each such site, the mobile mailbox unit 20 stops, where it may be unloaded preferably, as described above, it is partially unloaded automatically, i.e., unloaded only from those mailbox bins 11 which were assigned to the user(s) at that particular remote site 110*a*, *b*, or *c*, etc. As illustrated in this example, especially FIGS. 2, 3 and 6, with corresponding bin doors 52 and 122 open and adjacent, job sets ejected from the assigned unit 20 bin 11 by ejector 109 are automatically pushed into the assigned receiving bin 121.

The bin 121 assignments in the particular job delivery receiving unit 120 may be variable, and reassigned automatically, interactively, by signals from module 20 controller 100 to another such controller 100 in each unit 120. Preferably, job set site delivery requires a proper unique user code signal at that site to unlock respective bin doors of either the units 20 or 120. The units 120 as well as 20 may also be interactively connected to the various users' workstations or terminals to display and signal receipt and bin locations of delivered jobs, approximate expected delivery times, and/or the like.

As shown, the printer may have a docking and undocking sensor 130 which causes the printer to automatically direct its output sheets to another, or stationary mailbox, as described above, or to a stacking tray, whenever the moving mailbox unit 20 is undocked (i.e., is in its remote sets distribution mode). This prevents accidentally dumping printer output while the unit 20 is undocked.

As noted, the disclosed unit 20 is desirably a universal stand-alone unit that is simply moved next to, the output of almost any conventional printer. Plural units 20 may be ganged in series, like plural sorters, if desired, for an increased number of available bins, using conventional sheet pass-through feeders and gates and/or the bypass 22 shown herein, or the like. The job sorting unit 20 can take sheets inputted at its sheet input 13 from various printer outputs, including multi-functional units.

An alternative would be to have the mobile mailbox unit 20 per se not integrally include the mailbox array. In that case, the mailbox array could be picked up from the printer outlet location onto the module 20, like a forklift truck, or the like. Another alternative is for the unit 20 to carry the printer around with it, i.e., for the printer and mailbox to move integrally.

While the embodiment disclosed herein is preferred, it will be appreciated from this teaching that various alternatives, modifications, variations or improvements therein may be made by those skilled in the art, which are intended to be encompassed by the following claims:

What is claimed is:

1. An output sheets collection, separation and distribution system for printed sheets outputted from a shared centralized printer at a centralized printer location to which plural remote users electronically send respective print jobs, said plural remote users being located at a plurality of separate user sites in different locations remote from said centralized printer location; comprising a mobile mailboxing module dockable with said centralized printer to collect said outputted sheets, said mobile mailboxing module having an arrayed multiplicity of user-assigned mailbox bins and a distribution system for automatically collecting said outputted sheets of said centralized printer in user print jobs of plural said outputted sheets which are stacked into different user-assigned mailbox bins for different respective users of said centralized printer, said mobile mailboxing module distribution system including a sheet feeding system for automatically feeding said outputted sheets from said centralized printer to said respective user-assigned mailbox bins to stack said user print jobs therein, and said mobile mailboxing module being a vehicular print jobs distributor automatically sequentially movable to various said plurality of separate user sites remote from said centralized printer location for distribution of said print jobs to respective said separate user sites from which print jobs were electronically sent to said centralized printer to be printed and stacked into said user assigned mailbox bins of said mobile mailboxing module.

2. The output sheets collection, separation and distribution system of claim 1, wherein said printer and said mobile mailboxing module therefor are shared by said remote plural users having respective distinguishable user electronic codes, and wherein at least some of said mailbox bins have lockable access restricting privacy doors respectively electronically unlockable by said respective remote user electronic access codes.

3. The output sheets collection, separation and distribution system of claim 2, wherein said separate user sites have plural stationary print job delivery bins, and said mobile mailboxing module further includes an automatic unloading system for unloading said print jobs from respective user-assigned mailbox bins into said stationary print job delivery bin for said user at said users site in response to said user electronic code.

4. The output sheets collection, separation and distribution system of claim 1, wherein at least some of said separate remote user sites have plural stationary print job delivery bins located at said sites.

5. The output sheets collection, separation and distribution system of claim 4, wherein said mobile mailboxing module further includes an automatic unloading system for unloading said print jobs from respective user-assigned mailbox bins into respective said stationary print job delivery bins for said users at said user sites.

6. The output sheets collection, separation and distribution system of claim 4, wherein said stationary print job delivery bins comprise a plurality of separate and normally locked mail bins for respective designated users, which locked mail bins are automatically unlocked by said mobile mailboxing module when said mobile mailboxing module contains a print job for a said respective designated user.

7. The output sheets collection, separation and distribution system of claim 4, wherein said mobile mailboxing module automatically stops at said stationary print job delivery bin at a said user's site and unlocks at least one said mailbox bin, and discharges that user's print job from that user's assigned mailbox bin into that stationary bin at that user's site.

8. The output sheets collection, separation and distribution system of claim 1, further including an additional, stationary, mailboxing module maintained at said printer and connected to said printer to selectively alternatively collect said output sheets of said printer in an arrayed multiplicity of mailbox bins in user print job sets of plural said output sheets per job set stacked into different respective user-assigned mailbox bins.

9. The output sheets collection, separation and distribution system of claim 1, wherein said remote users may optionally direct print jobs to be delivered to said sites other than their own.

10. The output sheets collection, separation and distribution system of claim 1, wherein plural said mailbox bins are lockable and are electronically unlockable by remote site print job receivers when said print job receivers are approached by said vehicular print jobs distributor.

* * * * *